US009581095B2

(12) United States Patent
Pursifull

(10) Patent No.: US 9,581,095 B2
(45) Date of Patent: Feb. 28, 2017

(54) METHODS AND SYSTEMS FOR A THROTTLE TURBINE GENERATOR

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 338 days.

(21) Appl. No.: 14/484,081

(22) Filed: Sep. 11, 2014

(65) Prior Publication Data

US 2016/0076469 A1 Mar. 17, 2016

(51) Int. Cl.

| | |
|---|---|
| ***F02D 41/00*** | (2006.01) |
| ***F02M 35/10*** | (2006.01) |
| ***F01D 15/10*** | (2006.01) |
| ***F02M 25/08*** | (2006.01) |
| *F02B 33/34* | (2006.01) |
| *F02B 39/10* | (2006.01) |
| *F02D 41/18* | (2006.01) |

(52) U.S. Cl.

CPC ..... *F02D 41/0032* (2013.01); *F01D 15/10* (2013.01); *F02M 25/089* (2013.01); *F02M 35/10222* (2013.01); *F02B 33/34* (2013.01); *F02B 39/10* (2013.01); *F02D 41/18* (2013.01); *F02D 2200/0402* (2013.01); *F02D 2200/0406* (2013.01); *F02D 2250/41* (2013.01)

(58) Field of Classification Search

CPC .. F02D 41/18; F02D 41/0032; F02D 2250/41; F02D 2200/0402; F02D 2200/0406; F01D 15/10; F02M 35/10222; F02M 25/089; F02B 33/34; F02B 39/10

See application file for complete search history.

(56) References Cited

U.S. PATENT DOCUMENTS

| | | | | |
|---|---|---|---|---|
| 8,112,985 | B2 * | 2/2012 | Uhrich | F01N 5/02 60/281 |
| 8,783,231 | B2 | 7/2014 | Leone | |
| 2013/0092125 | A1 * | 4/2013 | Leone | F02D 9/1055 123/319 |
| 2013/0092126 | A1 | 4/2013 | Leone et al. | |
| 2013/0228145 | A1 * | 9/2013 | Moyer | F02M 33/04 123/184.21 |
| 2014/0157774 | A1 | 6/2014 | McConville et al. | |
| 2015/0040860 | A1 * | 2/2015 | Reyenga | F02D 9/1015 123/337 |
| 2015/0120108 | A1 * | 4/2015 | Dudar | F02M 25/089 701/22 |

* cited by examiner

*Primary Examiner* — Hieu T Vo
*Assistant Examiner* — Arnold Castro
(74) *Attorney, Agent, or Firm* — Julia Voutyras; John D. Russell; B. Anna McCoy

(57) ABSTRACT

Methods and systems are provided for adjusting operation of a throttle turbine generator to enable improved canister purging. A pressure differential across an intake throttle may be harnessed to rotate a turbine coupled in a throttle bypass, the turbine in turn driving a generator to charge a battery. During low intake manifold vacuum conditions, the generator may be operated as a motor to rotate the turbine, and use a compressor effect of the turbine to purge fuel vapors from a fuel system canister.

20 Claims, 5 Drawing Sheets

METHODS AND SYSTEMS FOR A THROTTLE TURBINE GENERATOR

TECHNICAL FIELD

The present application relates to methods and systems for an engine system which includes a throttle turbine generator.

BACKGROUND AND SUMMARY

Some engine systems may include devices such as throttle turbine generators to use energy from a pressure difference across a throttle that is otherwise wasted in an intake passage of an engine. In some examples, such as shown by Leone et al. in US 20130092126, the throttle turbine generator includes a turbine mechanically coupled to a generator which may generate current that is supplied to a battery of the engine. By charging the battery with such a generator, fuel economy of the engine system may be improved. For example, the need to charge the battery with an engine driven generator is reduced.

The inventors herein have recognized that by coupling the turbine to a motor-generator, there may be conditions where the turbine may be driven by the motor. In particular, the motor-generator may be operated as a motor drawing current from a battery and rotating the turbine propeller as a compressor. In other words, the system may be operated as a turbine-driven generator or a motor-driven compressor, as required. By coupling the motor-driven compressor to a fuel vapor purge canister, during conditions when there is not sufficient intake manifold vacuum, canister purging can be achieved by drawing purge vapors using the compressor. This allows a canister purge rate to be maintained even when the intake manifold vacuum is not sufficient to maintain the desired purge rate. The compressor may alternatively be used to draw air through other vacuum requiring devices and actuators of the engine system.

In one example, a method of operating an engine system including a throttle turbine generator may comprise: selectively operating a motor-generator to rotate a turbine propeller coupled in an intake throttle bypass; and drawing fuel vapors from a fuel system canister into an engine intake manifold through the rotating propeller.

In this way, the fuel economy benefits of a throttle turbine generator are increased. By using the turbine during selected conditions to drive an electrical motor-generator, energy lost across an intake throttle can be recouped and engine operation is not necessitated for charging a system battery. By using the electrical motor-generator to drive the turbine propeller during selected other conditions, air may be drawn through a purge canister by operating the turbine as a compressor, thereby allowing canister purging even when there is insufficient manifold vacuum. By improving canister purging, and maintaining a canister purge rate over a larger range of engine operating conditions, engine exhaust emissions are improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for an engine with a throttle turbine generator. In some embodiments, an example engine system includes a throttle bypass around a throttle disposed in an intake system of the engine system. Further, the throttle bypass includes a turbine in communication with a motor-generator, as shown in the engine systems of FIGS. 1-2. An engine controller may be configured to perform a control routine, such as the routine of FIG. 3, to selectively operate the turbine generator in a first mode wherein a pressure differential across the throttle is harnessed via the turbine and the generator and stored as electrical energy in a system battery. The controller may additionally operate the turbine generator in a second mode wherein the motor drives the turbine as a compressor to draw purge air through a fuel system canister. The selection may be based on characteristics defined in a throttle map, such as the map of FIG. 4. An example turbine operation is shown with reference to FIG. 5.

Figure 1:
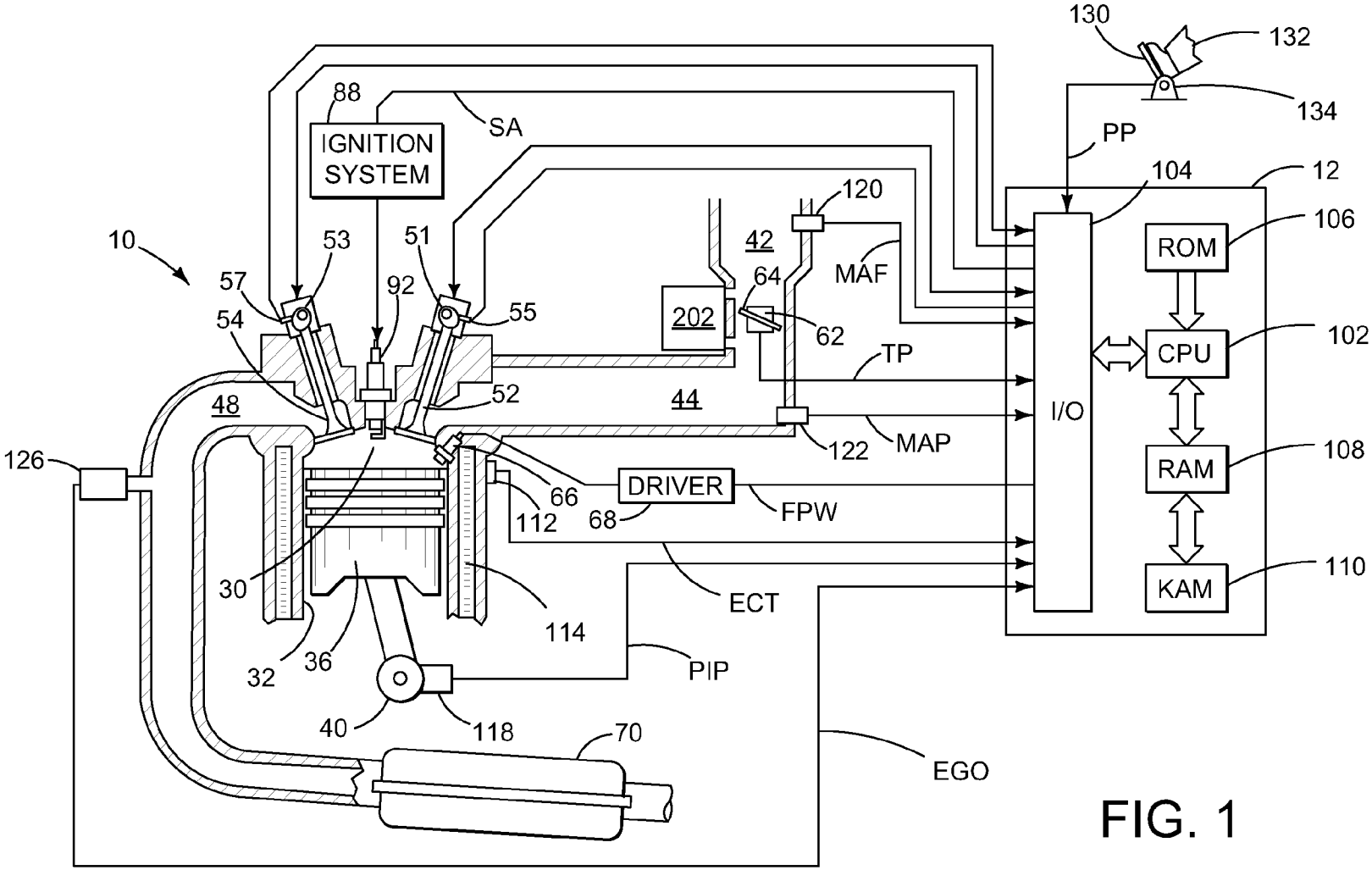
FIG. 1 shows a schematic diagram of an engine system.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and/or a manifold absolute pressure sensor 122 for providing respective signals MAF and MAP to controller 12.

Further, a throttle turbine generator 202 is coupled to intake passage 42 in a bypass around throttle 62. Throttle turbine generator 202, which will be described in greater detail with reference to FIG. 2, includes a turbine which drives a generator. In one example, the turbine drives an auxiliary generator to provide charge to a battery of the engine. The generator may be configured as a motor-generator. The charge delivered by the generator to the battery may be provided as a supplement to charging by a mechanically driven primary generator. As also elaborated at FIGS. 2-3, the motor-generator may also be operated as a motor during selected conditions, the motor driving the turbine propeller such that the turbine operates essentially as a compressor. In this way, the turbine can be used as a generator-driving turbine or a motor-driven compressor by adjusting the operation of the motor-generator responsive to engine operating conditions.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and manifold absolute pressure signal, MAP, from sensor 122. Engine speed signal, RPM, may be generated by controller 12 from signal PIP. Manifold absolute pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

Figure 2:
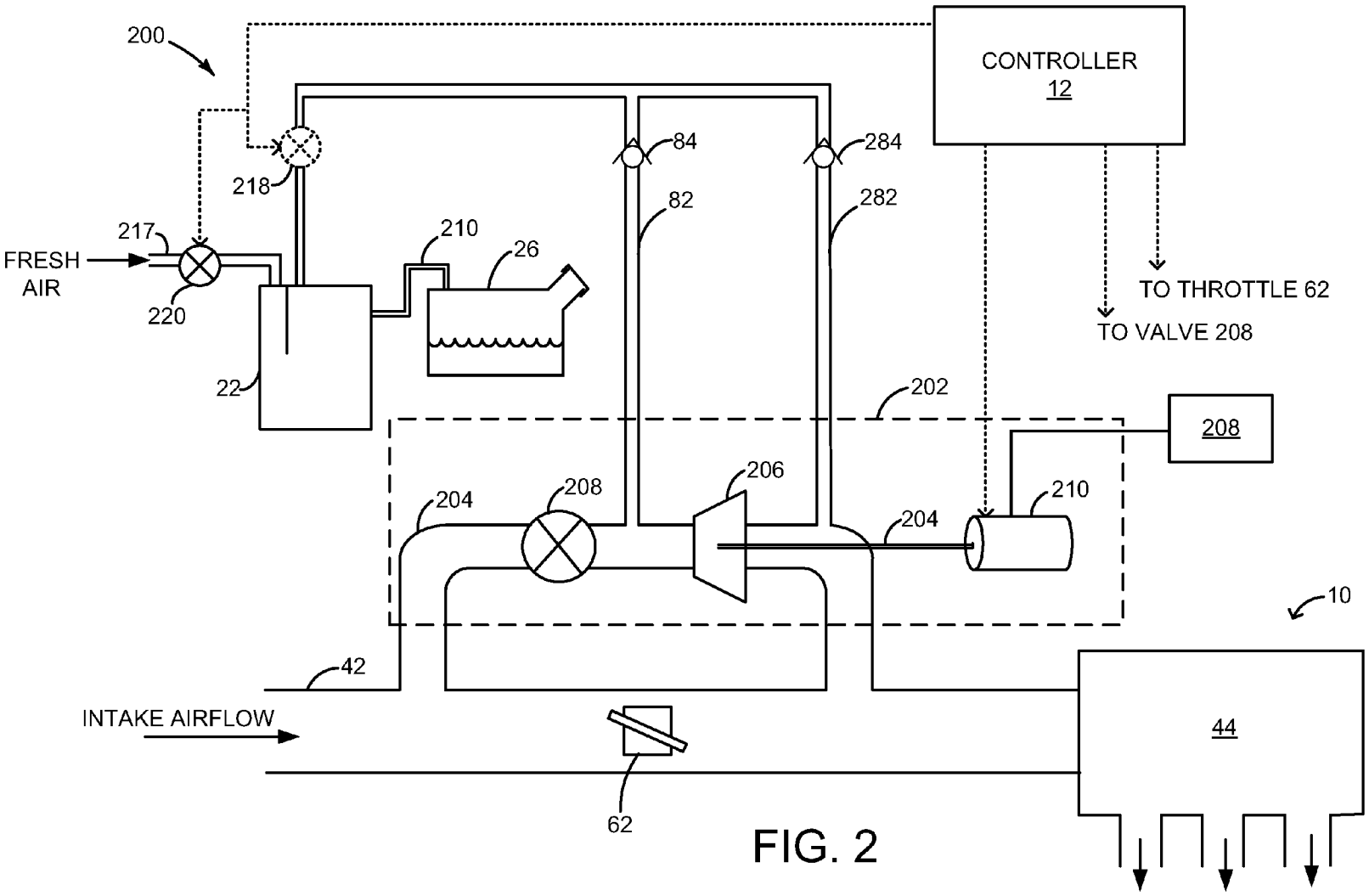
FIG. 2 shows a schematic diagram of a throttle turbine generator in an engine system.

Continuing to FIG. 2, throttle turbine generator 202 is shown in an engine system 200 which includes an engine 10 described above with reference to FIG. 1. Engine 10 is depicted with an intake manifold 44 for delivering air to engine cylinders. Throttle turbine generator 202 includes turbine 206 and throttle bypass valve 208 disposed in throttle bypass 204 and generator 210 which is driven by turbine 206. In particular, the rotation of turbine 206 is used to drive generator 210 via mechanical shaft 205.

Generator 210 may be configured as a motor-generator that may be operated to convert turbine torque received via shaft 205 into electrical energy to be stored in an electric energy storage device, such as battery 212. Additionally, the motor-generator may be operated to deliver torque along shaft 205 to rotate turbine 206. The motor-generator may consist of an electric motor mechanically coupled to an electric generator (or alternator). When operating in the generator mode, the generator creates an electrical output current. In particular, the rotating turbine drives the motor-generator which concurrently charges a battery electrically coupled to the motor-generator. In comparison, when operating in the motor mode, the motor runs on an electrical input current. In particular, charge (in the form of a current) is drawn from the battery to operate the motor-generator, the motor operation driving a rotation of the turbine. The rotating turbine can then act a compressor drawing in airflow to the intake manifold, such as via a fuel system canister. While operating in either mode, power may flow between the two electrical machines as mechanical torque, thereby providing electrical isolation and some buffering of power between the two electrical machines.

Throttle turbine generator 202 uses energy that is typically wasted by throttling engine intake air. For example, the change in pressure across throttle 62 may be used to direct airflow through turbine 206. Turbine 206 drives generator 210, which provides current to battery 212. In such a configuration, overall efficiency of the engine system may be improved. For example, where generator 210 is an auxiliary generator, charging of battery 212 via a mechanically driven primary generator may be reduced and charging via the auxiliary generator may be increased during some operating conditions. As such, this reduces the need for operating the engine to charge the battery.

As depicted, intake air flows through intake passage 42 and through throttle 62. As described below, a throttle position may be varied by controller 12 such that an amount of intake air provided to cylinders of the engine is varied. Throttle bypass 204 directs intake air from a position upstream of throttle 62 and around throttle 62 to a position downstream of throttle 62. The intake air may be directed through throttle bypass 204 and turbine 206 by a pressure difference across the throttle, for example. Further, in the example embodiment shown in FIG. 2, throttle turbine generator 202 includes throttle bypass valve 208. Throttle bypass valve 208 may be modulated to adjust the flow of intake air through throttle bypass 204. In some examples, throttle bypass valve 208 may be an on/off valve which opens and closes throttle bypass 204. In other examples, throttle bypass valve 208 may be a flow modulating valve which controls a variable amount of airflow through throttle bypass 204. Throttle bypass valve 208 may be a plunger or spool valve, a gate valve, a butterfly valve, or another suitable flow control device. Further, throttle bypass valve 208 may be actuated by a solenoid, a pulse width modulated solenoid, a DC motor, a stepper motor, a vacuum diaphragm, or the like.

Airflow directed through throttle bypass 204 flows through turbine 206 which spins generator 210 via shaft 205 with energy extracted from the airflow. Generator 210 generates current which is supplied to battery 212. Battery 212 may provide power to various components of an electrical system of the vehicle in which engine system 200 is disposed, such as lights, pumps, fans, fuel injection, ignition, air-conditioning, and the like. In embodiments where generator 210 is an auxiliary generator, battery 212 may be further charged by a primary generator (not shown) which is mechanically driven by engine 10. Therein, the auxiliary generator may be a less powerful generator, for example, which generates less current than the primary generator.

Engine system 100 further includes fuel tank 26, which stores a volatile liquid fuel combusted in engine 10. To avoid emission of fuel vapors from the fuel tank and into the atmosphere, the fuel tank is vented to the atmosphere through adsorbent canister 22. The adsorbent canister may have a significant capacity for storing hydrocarbon-, alcohol-, and/or ester-based fuels in an adsorbed state; it may be filled with activated carbon granules and/or another high surface-area material, for example. Nevertheless, prolonged adsorption of fuel vapor will eventually reduce the capacity of the adsorbent canister for further storage. Therefore, the adsorbent canister may be periodically purged of adsorbed fuel, as further described hereinafter. In the configuration shown in FIG. 2, the fuel system is configured with a dual purge path. Specifically, a canister-purge valve 218 controls the purging of fuel vapors from the canister into the intake manifold along one of purge line 282 and purge line 82. Purge line 82 may be coupled to intake manifold 44 at a location upstream of turbine 206 and downstream of valve 208 in throttle bypass 204. An optional check valve 84 may be coupled in purge line 82 to prevent backflow from intake manifold 44 into canister 22. Purge line 282 may be coupled to intake manifold 44 at a location downstream of turbine 206 in throttle bypass 204. An optional check valve 284 may be coupled in purge line 282 to prevent backflow from intake manifold 44 into canister 22.

When purging conditions are met, such as when the canister is saturated, vapors stored in fuel vapor canister 22 may be purged to intake manifold 44 by opening canister purge valve 218. While a single canister 22 is shown, it will be appreciated that any number of canisters may be coupled in engine system 100. In one example, canister purge valve 218 may be a solenoid valve wherein opening or closing of the valve is performed via actuation of a canister purge solenoid. Canister 22 further includes a vent 217 for routing gases out of the canister 22 to the atmosphere when storing, or trapping, fuel vapors from fuel tank 26. Vent 217 may also allow fresh air to be drawn into fuel vapor canister 22 when purging stored fuel vapors to intake manifold 44 via purge line 82 and purge valve 218. While this example shows vent 217 communicating with fresh, unheated air, various modifications may also be used. Vent 217 may include a canister vent valve 220 to adjust a flow of air and vapors between canister 22 and the atmosphere.

During conditions when there is a large pressure differential across throttle 62 and while turbine 206 is operated in a turbine-generator mode, fresh air drawn into fuel vapor canister 22 via vent 217 may be used to purge stored fuel vapors to intake manifold 44 via purge line 282 and purge valve 218 at a location downstream of the turbine.

During conditions when the engine is operating without boost and there is sufficient intake manifold vacuum, canister 22 may be purged to the engine intake manifold using the available intake manifold vacuum. In particular, vent valve 220 and purge valve 218 may be opened so that fresh air can be drawn through vent 217 via the intake manifold vacuum. The fresh air drawn in through the vent is then drawn into canister 22 and fuel vapors released from canister 22 are purged to the engine intake manifold 44 along one of purge lines 82 and 282. During conditions when the engine is operating without boost and there is insufficient intake manifold vacuum, however, canister purging may be limited. If the canister load is above a level where purging is required, the lack of sufficient vacuum can lead to degraded exhaust emissions. In addition, it may be desired to maintain a relatively consistent (e.g., constant) canister purge rate to improve engine fuel economy.

During those conditions, when intake manifold vacuum is limited, generator 210 may be selectively operated to rotate the turbine coupled in the intake throttle bypass. Fuel vapors may then be drawn in through fuel system canister 22 into the engine intake manifold 244 via the rotation of the turbine 206, which is being operated as a compressor. In particular, the compressor effect of actively rotating the turbine (or propeller) via the motor-generator may be advantageously used to draw air through the canister and purge the canister fuel vapors to the engine intake. This allows air to be drawn in through the canister when intake manifold vacuum is limited. In addition, a canister purge rate may be maintained over a larger range of engine operating conditions.

Figure 3:
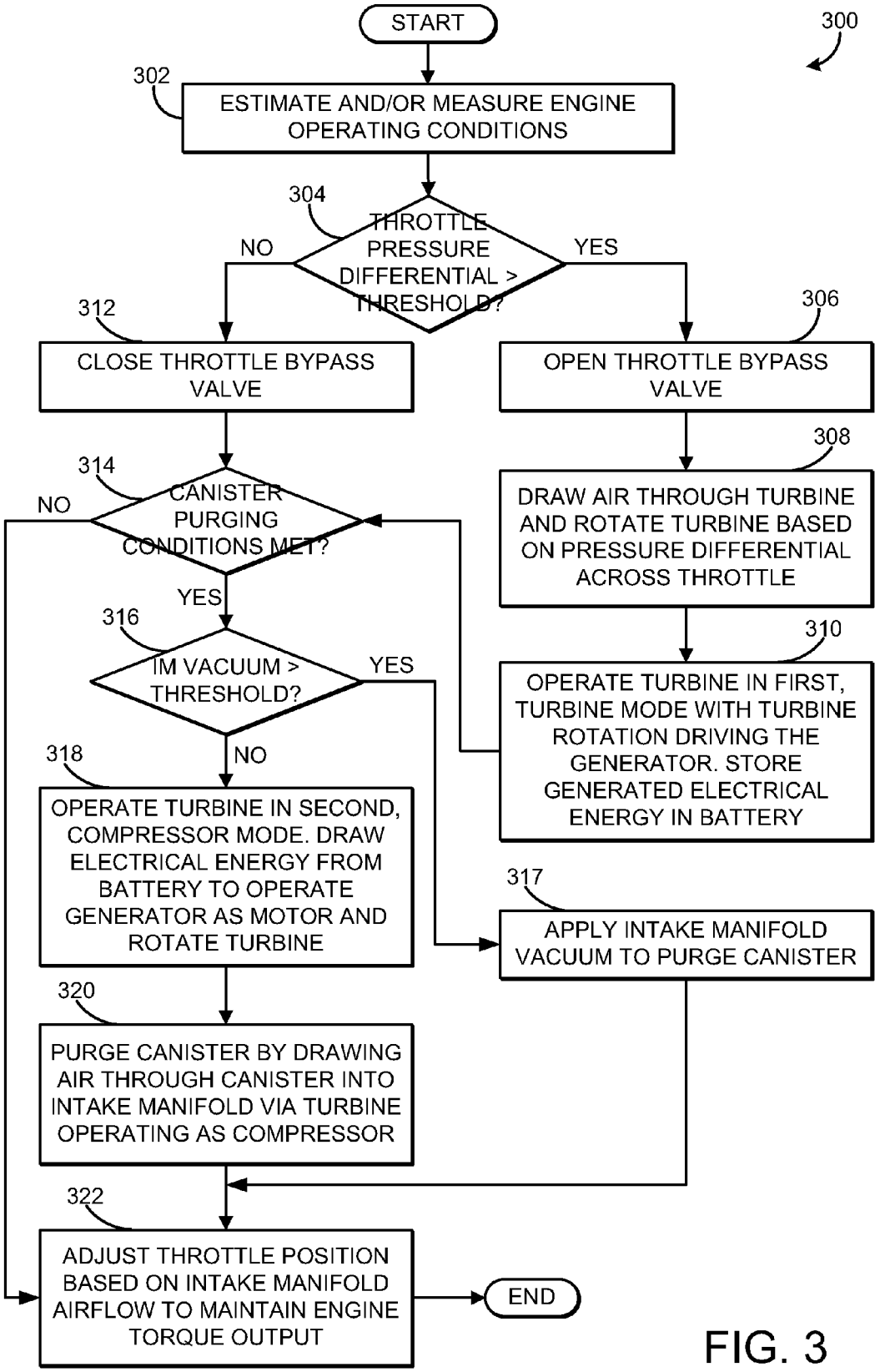
FIG. 3 shows a flow chart illustrating a routine for adjusting an operating mode of a turbine of the throttle turbine generator between a first turbine mode for electrical energy generation, and a second, compressor mode for canister purging.

As elaborated with reference to FIG. 3, an engine controller may operate the engine in a first mode with the turbine and generator operating as a turbine-driven generator. The engine controller may alternatively operate the engine in a second mode with the turbine and generator operating as a motor-driven compressor. The controller may select between the two modes based on engine operating conditions including intake manifold vacuum, and canister load.

Figure 4:
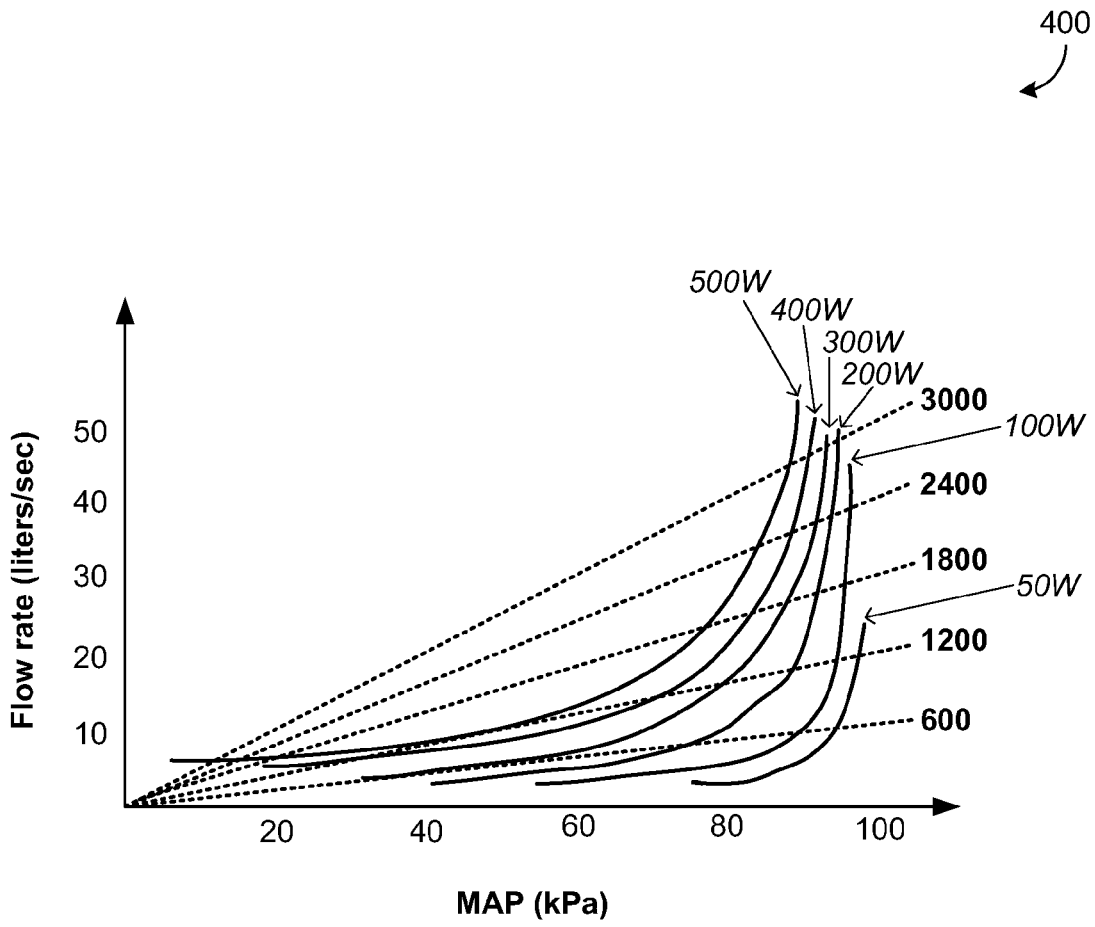
FIG. 4 shows an example throttle map for the throttle turbine generator of FIG. 2.

In addition, the selection may be based on throttle conditions relative to a map, such as the throttle map of FIG. 4. Map 400 of FIG. 4 overlays the flow map of an engine and the air power lost via throttling. Thus, using map 400, for any engine operating point, the air power available for capture by a turbine-generator system may be determined. The engine operating point may be defined by any two of three parameters, namely MAP (across the x-axis), engine speed (dashed lines emanating from a common origin), and engine flow rate (along the y-axis). The lines of constant air power are depicted as hyperbolas. Assuming the fluid is incompressible, the available power across the throttle is determined as power=volume flow rate×pressure. The engine flow rate is determined as a function of engine speed and MAP. For example, the power may be determined as the pressure difference (e.g., BP−MAP=10 kPa) multiplied by the flow rate (5 liters/sec)=50 W. Thus 50 W of air power are available at several points of differing combination of throttle pressure difference and flow rate: 5 kPa and 10 l/s, 2.5 kPa and 20 l/s, 10 kPa and 5 l/s, 25 kPa and 2 l/s. That line of constant power is a hyperbola.

For any given speed, the available throttle power increases with manifold vacuum (that is, decreases with MAP). In the depicted map, the 600 rpm line crosses multiple lines of constant throttle power. Thus, by knowing the engine operating point, available throttle air power can be computed.

As shown, the available air power increases with intake manifold vacuum (which is determined as the difference between barometric pressure and manifold pressure, or BP−MAP) and engine air flow rate. It will be noted that as the manifold vacuum drops (such as when MAP is above 90 kPa), the available air power drops sharply. When the available air power drops, the utility of the device as a turbine generator reduces. However, at the same time, the utility of the device as a motor-compressor improves substantially in the low vacuum region. In particular, the turbine can be operated as a motor-compressor in this region to provide vacuum for fuel vapor purge. Alternatively, the motor compressor may be used to provide vacuum for EGR, crankcase ventilation, or other vacuum operated actuators.

A controller may select a line of constant power as a threshold for determining whether or not to operate the turbine as a turbine or a compressor. For example, based on engine operating conditions, including engine speed, engine flow rate, and MAP, the controller may determine the available power. If the power is higher than the threshold (e.g, higher than 300 W), the controller may operate the turbine as a turbine driving a generator to generate an electrical output. Else, if the available power is less than the threshold, the controller may wait for engine operating conditions to change (e.g., engine speed to increase or MAP to decrease) before operating the turbine as a turbine. In addition, below the threshold, the controller may operate the turbine as a compressor being driving by a motor using energy drawn from a system battery.

It will be appreciated that FIG. 4 maps the available air power. As such, this is distinct from requisite compressor power, which tends to be lower due to the presence of a lower flow rate (e.g. 2 liters per second) and a vacuum enhancement of around 10 kPa. In that case, it would require 20 air watts which may require 100 W of shaft work and 150 W of electrical power.

Now turning to FIG. 3, an example routine 300 is shown for operating a throttle turbine generator of an engine system in different modes based on operating conditions including a purge requirement of a fuel system canister. The routine enables the engine system to be operated, during non-boosted conditions, as a turbine driven generator in a first mode with the turbine operating as a turbine and the generator operating as a generator. Then, during other non-boosted conditions, the engine system is operated in a second mode, as a motor driven compressor with the turbine operating as a compressor to draw in air through a fuel system canister and the generator operating as a motor.

At 302, engine operating conditions may be estimated and/or measured. These may include, for example, engine speed, engine load, engine temperature, canister load, manifold pressure, manifold air flow, boost pressure, torque demand, ambient conditions, intake manifold vacuum level, etc.

Upon confirming non-boosted conditions, at 304, the routine includes estimating a throttle differential pressure and comparing it to a threshold. In particular, it may be determined if the throttle differential pressure is higher than a threshold. In one example, the throttle differential pressure may be estimated based on pressure sensors coupled upstream and downstream of the throttle. Alternatively, the throttle differential pressure may be estimated based on manifold air flow.

If the throttle differential pressure is higher than the threshold, then at 306, the routine includes opening the throttle bypass valve to direct air flow corresponding to the differential pressure into the bypass. In one example, where the bypass valve is an on/off valve, the valve may be shifted to the on position. In another example, where the bypass valve is a variable valve, the valve opening may be increased based on a desired flow through the turbine.

At 308, the routine includes directing the intake air flow diverted to the intake throttle bypass through the throttle turbine to rotate the throttle turbine. The amount of air drawn through the turbine may be based on the pressure differential across the intake throttle. Specifically, as the pressure difference across the throttle increases, the amount of air directed through the throttle turbine may increase.

At 310, the routine includes operating the engine system turbine in a first mode with the rotation of the turbine in the intake throttle bypass driving the motor-generator. While the rotating turbine drives the motor-generator, a battery electrically couple to the motor-generator may be charged with the generated electrically energy. Herein, when the rotating turbine drives the motor-generator, the motor-generator acts as a generator and the turbine operates as a turbine. In the first mode, an electrical output of the turbine is higher. In one example, the electrical output of the turbine may be the same as or higher than an electrical load applied on a system battery. This may allow the demand of the electrical load to be met using the electrical output of the turbine and the battery to be charged if the electrical output from the turbine exceeds the electrical load. Returning to 304, if the pressure differential across the throttle is less than the threshold, then at 312, the routine closing the throttle bypass valve to disable air flow into the bypass. In one example, where the bypass valve is an on/off valve, the valve may be shifted to the off position. In another example, where the bypass valve is a variable valve, the valve opening may be decreased.

From each of 312 and 310, the routine moves to 314 where it is determined if canister purging conditions have been met. In one example, canister purging conditions may be considered met if the canister load is higher than a threshold. In another example, canister purging conditions may be considered met if a threshold duration or distance has elapsed since a last purging of the canister. If canister purging conditions are not met, the routine may proceed to 322 wherein the throttle position is adjusted based on airflow through the turbine, if present, to reduce torque disturbances.

It will be appreciated that in alternate examples, canister purging conditions may not be queried and canister purging may always be enabled while the engine is operating to allow for a substantially constant purge flow rate during engine operation.

Upon confirming canister purging conditions, at 316, the routine includes estimating the intake manifold vacuum level and comparing it to a threshold. The threshold may be based on engine operating conditions such as a fuel vapor load of the fuel system canister. For example, the threshold may be increased as the canister load increases and the amount of vacuum required to completely purge the canister increases.

If the intake manifold vacuum is higher than the threshold, it may be determined that there is sufficient intake manifold vacuum for drawing air through a fuel canister and purging the canister to the engine intake. Accordingly, at 317, the routine includes drawing fuel vapors from the fuel system canister into the engine intake manifold via the intake manifold vacuum. Therein, the controller may open the vent valve and the purge valve and allow the intake manifold vacuum to be applied on the fuel system canister so that fresh air is drawn in to the fuel system canister to desorb fuel vapors from canister, the desorbed fuel vapors then delivered to the engine intake manifold along the purge line. If the turbine is operating in the first mode while the canister purge valve is opened, the desorbed fuel vapors may be drawn into the throttle bypass at a location downstream of the turbine, along purge line 282, before the fuel vapors are delivered to the intake manifold. After receiving the purge fuel vapors, the routine may move to 322 to adjust the throttle position based on the purge flow received to reduce torque disturbances.

In comparison, if the intake manifold vacuum is lower than the threshold, it may be determined that there is insufficient intake manifold vacuum for drawing air through a fuel canister and purging the canister to the engine intake. Accordingly, at 318, the routine includes operating the engine system turbine in a second mode with the turbine in the intake throttle bypass being driven by the motor-generator. Specifically, the controller may selectively operate the motor-generator by drawing charge from the battery to rotate the turbine. Herein, when the motor-generator drives the rotation of the turbine, the motor-generator acts as a motor and the turbine operates as a compressor. In the second mode, the electrical output of the turbine is lower. For example, there is no electrical output from the turbine when operating in the second mode.

At 320, the routine includes drawing fresh air through the fuel system canister and drawing fuel vapors from the fuel system canister into the engine intake manifold via the rotation of the turbine operating as a compressor. The fuel vapors may be drawn into the throttle bypass, downstream of the bypass valve and upstream of the throttle turbine. By enabling fuel vapors to be drawn into the intake manifold through the turbine using intake manifold vacuum when sufficient intake manifold vacuum is available, and further enabling fuel vapors to be drawn into the intake manifold through the turbine using turbine rotation via the motor (and the consequent compressor action) when sufficient intake manifold vacuum is not available, canister purging may be enabled over a wide range of intake manifold vacuum levels. In one example, the need for a dedicated purge valve that enables or disables air flow through the canister based on intake vacuum availability is reduced. For example, the canister purge valve of FIG. 2 may be removed.

During both modes of turbine operation, a position of the intake throttle may be adjusted based on flow through the turbine to maintain an engine torque output. Specifically, from each of 320 and 317 (or 314), the routine may proceed to 322 wherein the intake throttle opening is adjusted based on intake manifold airflow. As an example, when the turbine is driving the motor-generator and air is flowing through the throttle bypass, an intake throttle opening may be increased based on the amount of throttle bypass flow through the turbine to maintain engine torque as well as the amount of canister purge flow received downstream of the turbine (if purging was enabled). In another example, when the turbine is driven by the motor-generator and air is flowing through the canister and then into the throttle bypass, the intake throttle opening may be decreased based on purge flow received from the canister. Since the canister flows a mixture of air and vapor, the more air that is sourced from the purge system, the less air that is metered in other paths.

In this way, the engine may be operated with no boost an engine in a first mode, when intake vacuum is above a threshold, with a turbine coupled in a throttle bypass driving a motor-generator. Further, the engine may be operated with no boost in a second mode, when intake vacuum is below the threshold, with the turbine coupled in the throttle bypass being driven by the motor-generator. Herein, during the first mode, air is drawn through the turbine into an intake manifold to drive the motor-generator. In comparison, during the second mode, air is drawn through the fuel vapor canister and via the turbine into the intake manifold. Further, during the first mode, the fuel vapor canister is purged using intake manifold vacuum, while during the second mode, the fuel vapor canister is purged using the air drawn into the intake manifold via rotation of the turbine. Thus, during the first mode, the motor-generator operates as a generator and electrical energy is stored in a battery coupled to the motor-generator; while during the second mode, the motor-generator operates as a motor and electrical energy is drawn from the battery coupled to the motor-generator. In other words, during the second mode, the turbine is switched from a turbine mode of operation to a compressor mode of operation. During the first mode, a bypass valve coupled in the throttle bypass upstream of the turbine may be opened, while during the second mode, a purge valve coupled between the canister and the throttle bypass may be opened. During the second mode, the bypass valve is opened based on a pressure difference across the throttle and a desired bypass flow. In addition, during both modes, throttle adjustments are used to maintain engine torque. For example, during the first mode, the intake throttle opening is increased based on throttle bypass flow through the turbine, while during the second mode, the intake throttle opening may be decreased based on purge flow from the canister.

Figure 5:
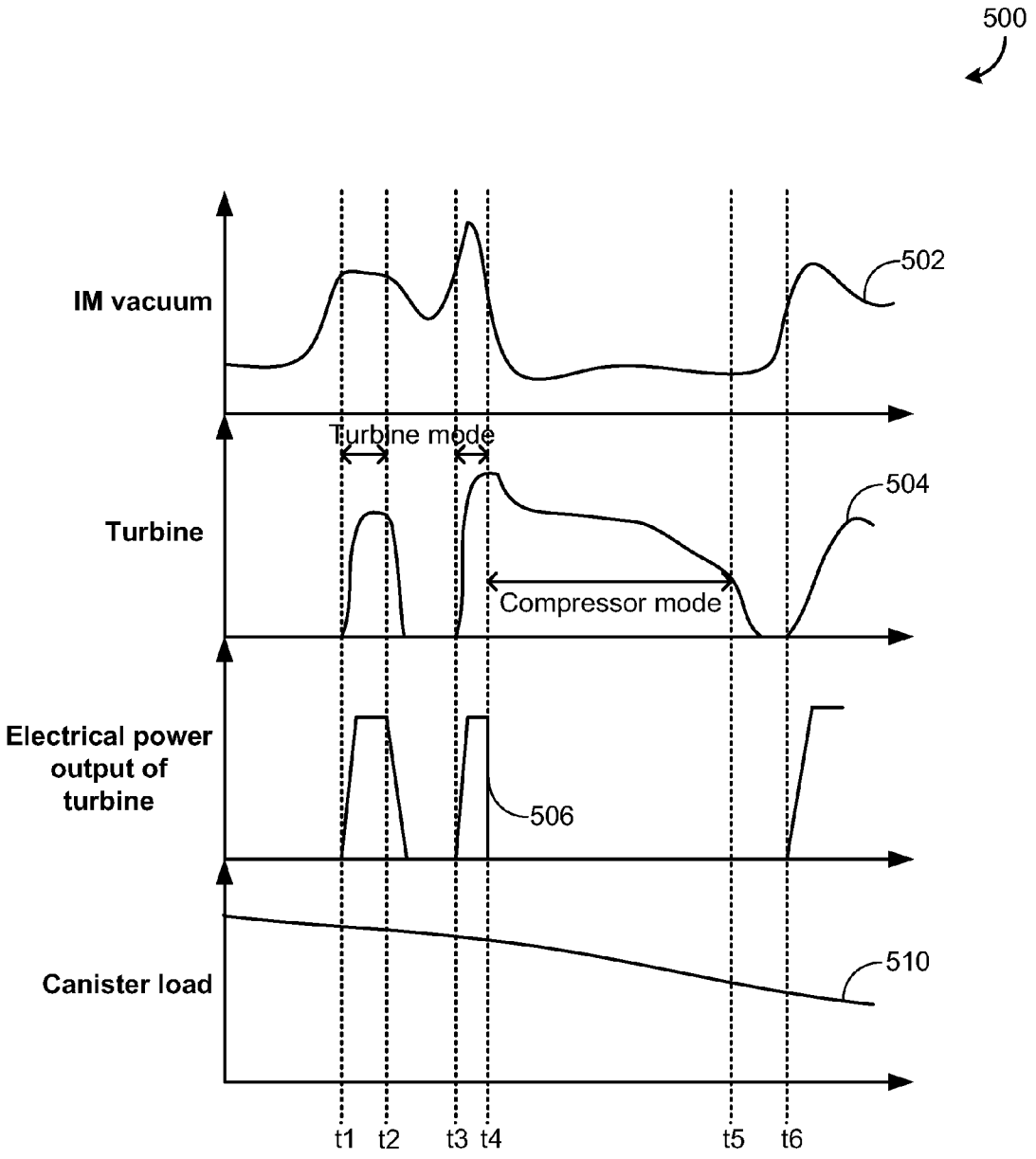
FIG. 5 shows an example operation of the turbine as a turbine and a compressor during different operating conditions.

Now turning to FIG. 5, an example control scenario 500 is shown for adjusting turbine operation based on engine operating conditions. In particular, turbine operation is adjusted between a turbine mode and a compressor mode by adjusting the operation of a motor-generator. Map 500 depicts intake manifold vacuum at plot 502, turbine rotation at plot 504, an electrical power output of the turbine at plot 506, and a fuel system canister load at plot 508.

Prior to t1, the engine may be operating without boost and with sufficient intake manifold vacuum. However, there may not be sufficient differential pressure across the throttle to harness the throttle bypass flow for turbine rotation and electrical energy generation. Accordingly, the turbine is not operated as no bypass flow is generated.

At t1, while operating the engine without boost, in response to an increase in differential pressure across the throttle, a throttle bypass valve may be opened and intake air flow may be directed through the throttle turbine resulting in turbine rotation. Between t1 and t2, while there is sufficient differential pressure across the throttle, flow may be continuously directed through the turbine. That is, the high pressure differential across the throttle may drive the turbine rotation. In addition, between t1 and t2, the turbine may be operated in a turbine mode with the turbine rotation driving a generator, the generator generating electrical energy that is stored in a system battery. Corresponding to the high pressure differential across the throttle, between t1 and t2, an electrical output of the turbine may increase as the turbine is rotated via the throttle bypass flow and as the turbine drives the generator.

Also between t1 and t2, a throttle opening may be adjusted based on the throttle bypass flow to maintain engine torque output. In this example, the throttle opening may be increased as the throttle bypass flow increases.

At t2, due to a change in operating conditions, a differential pressure across the throttle may drop. Accordingly, between t2 and t3, the throttle bypass valve may be closed and the turbine may not be rotated via the air flow. Consequently, the electrical output of the turbine may drop. At t3, when the differential pressure across the throttle is sufficiently high again, the throttle bypass valve may be opened again and the turbine may be operated in the turbine mode, driving the generator, with a corresponding increase in the turbine electrical output.

As such, between t1 and t4, while the engine is running, and while there is sufficient intake manifold vacuum, the canister may be purged to the engine intake, for example, at a substantially constant purge rate. The constant canister purging is represented as a monotonic decrease in canister load during engine operation. The canister purging may include purging the canister to the engine intake using intake manifold vacuum by drawing purge flow into the throttle bypass upstream of the turbine (such as via purge line 82 of FIG. 2) when the turbine is not rotating, such as at t0-t1 and t2-t3. The purging may also include purging the canister to the engine intake using intake manifold vacuum by drawing purge flow into the throttle bypass downstream of the turbine (such as via purge line 282 of FIG. 2) when the turbine is rotating, such as at t1-t2 and t3-t4.

At t4, due to a change in engine operating conditions, there may be a drop in intake manifold vacuum. Due to the insufficient manifold vacuum, the canister may not be purged with the intake vacuum. Accordingly, at t4, to enable the canister to continue to be purged while the engine is operating with low intake manifold vacuum, the turbine may be rotated as a compressor via operation of the motor-generator as a motor. The motor may draw electrical energy from the battery to drive the turbine, the rotation of the turbine resulting in a compressor mode of operation which draws fresh air into the intake manifold via the canister, with fuel vapors being purged to the intake. While the turbine is operated in the compressor mode, the electrical output of the turbine may drop. In addition, while the turbine is operated in the compressor mode, the throttle bypass valve may be held closed. While the canister is purged using air flow drawn in via the turbine acting as a compressor, the throttle opening may be adjusted, herein decreased, based on the received purge flow to maintain engine torque output. Additionally, engine fueling may be adjusted based on an air-fuel ratio of the purge vapors.

At t5, the intake manifold vacuum may rise. Thus at t5, the canister may resume being purged using the intake vacuum. In addition, turbine rotation via the motor may be discontinued. At t6, while the canister is purged using intake vacuum, there may be a rise in differential pressure across the throttle. Accordingly, the throttle bypass valve is opened again and the turbine is rotated via the airflow, the turbine driving the generator, and the turbine electrical output rising. Herein, electrical output generation via the turbine and canister purging via intake manifold vacuum may occur concurrently.

In one example, a system comprises a throttle disposed in an intake passage of an engine; a throttle bypass configured to route intake air from a position upstream of the throttle to a position downstream of the throttle, the throttle bypass including a throttle bypass valve; a turbine disposed in the throttle bypass, the turbine mechanically coupled to a motor-generator the motor-generator in electrical communication with a battery; a fuel system including a canister configured to receive fuel vapors from a fuel tank, the canister coupled to the throttle bypass downstream of the bypass valve and upstream of the turbine via a purge valve; and a controller. The controller may be configured with computer readable instructions stored on non-transitory memory for: when intake manifold vacuum is lower, operating the motor-generator while drawing energy from the battery to rotate the turbine as a compressor; and drawing intake air through the canister into an intake manifold via the rotation of the turbine as a compressor to purge the canister. The controller may include further instructions for, when the intake manifold vacuum is higher, drawing intake air through the throttle bypass to rotate the turbine and drive the motor-generator while storing energy in the battery; and purging the canister by drawing intake air through the canister into the intake manifold using the intake manifold vacuum. Herein, when the intake manifold vacuum is higher, the turbine operates as a generator-driving turbine, while when the intake manifold vacuum is lower, the turbine operates as a motor-driven compressor. The controller may also include instructions for increasing an opening of the throttle during the drawing of intake air through the throttle bypass to rotate the turbine and drive the motor-generator; and decreasing an opening of the throttle during the drawing of intake air through the canister to purge the canister.

In this way, a throttle turbine generator coupled to a fuel system canister can be advantageously used during low manifold vacuum conditions to purge the canister. The technical effect of operating a motor to drive the turbine as a compressor is that purge air can be drawn in to an engine intake through a canister, allowing for a canister purge rate to be maintained over a wide range of intake manifold conditions. By driving a generator via a throttle turbine by harnessing throttle bypass flow, energy that would have otherwise been lost can be recouped. By allowing the system battery to be opportunistically charged, engine fuel economy is improved. By then driving the turbine as a compressor via the motor during low manifold vacuum conditions, canister purging efficiency is increased, thereby improving exhaust emissions.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

selectively operating a motor-generator to rotate a turbine coupled in an intake throttle bypass; and drawing fuel vapors from a fuel system canister into an engine intake manifold via the rotation of the turbine.

2. The method of claim 1, wherein the selectively operating includes operating the motor-generator during conditions when the engine is operating without boost and while the intake manifold vacuum is lower than a threshold.

3. The method of claim 2, further comprising, during conditions when the engine is operating without boost and the intake manifold vacuum is higher than the threshold, drawing fuel vapors from the fuel system canister into the engine intake manifold via intake manifold vacuum.

4. The method of claim 3, further comprising, during conditions when the engine is operating without boost and the intake manifold vacuum is higher than the threshold, directing intake air through the intake throttle bypass and through the turbine to rotate the turbine, the rotating turbine driving the motor-generator.

5. The method of claim 4, further comprising, while the rotating turbine drives the motor-generator, charging a battery electrically coupled to the motor-generator.

6. The method of claim 5, wherein selectively operating the motor-generator to rotate the turbine includes drawing charge from the battery.

7. The method of claim 4, wherein when operating the motor-generator to rotate the turbine, the motor-generator is operating as a motor, and when the rotating turbine drives the motor-generator, the motor-generator is operating as a generator.

8. The method of claim 4, wherein when operating the motor-generator to rotate the turbine, the turbine is operating as a compressor, and when the rotating turbine drives the motor-generator, the turbine is operating as a turbine.

9. The method of claim 2, wherein the threshold is based on a load of the fuel system canister.

10. A method, comprising:

operating an engine in a first mode, when intake vacuum is above a threshold, with a turbine coupled in a throttle bypass driving a motor-generator; and operating the engine in a second mode, when intake vacuum is below the threshold, with the turbine coupled in the throttle bypass being driven by the motor-generator.

11. The method of claim 10, wherein during the first mode, air is drawn through the turbine into an intake manifold to drive the motor-generator, and wherein during the second mode, air is drawn through a fuel vapor canister and via the turbine into the intake manifold.

12. The method of claim 11, wherein during the first mode, the fuel vapor canister is purged using intake manifold vacuum, and wherein during the second mode, the fuel vapor canister is purged using the air drawn into the intake manifold via rotation of the turbine.

13. The method of claim 12, wherein during the first mode, the motor-generator operates as a generator and electrical energy is stored in a battery coupled to the motor-generator; and wherein during the second mode, the motor-generator operates as a motor and electrical energy is drawn from the battery coupled to the motor-generator.

14. The method of claim 10, wherein during the second mode, the turbine is switched from a turbine mode of operation to a compressor mode of operation.

15. The method of claim 11, wherein during the first mode, a bypass valve coupled in the throttle bypass upstream of the turbine is opened, and wherein during the second mode, a purge valve coupled between the canister and the throttle bypass is opened.

16. The method of claim 11, wherein during the first mode, an intake throttle opening is increased based on throttle bypass flow through the turbine, and wherein during the second mode, the intake throttle opening is decreased based on purge flow from the canister.

17. A system, comprising:

a throttle disposed in an intake passage of an engine;

a throttle bypass configured to route intake air from a position upstream of the throttle to a position downstream of the throttle, the throttle bypass including a throttle bypass valve;

a turbine disposed in the throttle bypass, the turbine mechanically coupled to a motor-generator the motor-generator in electrical communication with a battery;

a fuel system including a canister configured to receive fuel vapors from a fuel tank, the canister coupled to the throttle bypass downstream of the bypass valve and upstream of the turbine via a purge valve; and a controller configured with computer readable instructions stored on non-transitory memory for:

when intake manifold vacuum is lower, operating the motor-generator while drawing energy from the battery to rotate the turbine as a compressor; and drawing intake air through the canister into an intake manifold via the rotation of the turbine as a compressor to purge the canister.

18. The system of claim 17, wherein the controller includes further instructions for:

when the intake manifold vacuum is higher, drawing intake air through the throttle bypass to rotate the turbine and drive the motor-generator while storing energy in the battery; and purging the canister by drawing intake air through the canister into the intake manifold using the intake manifold vacuum.

19. The system of claim 18, wherein when the intake manifold vacuum is higher, the turbine operates as a generator-driving turbine, and wherein when the intake manifold vacuum is lower, the turbine operates as a motor-driven compressor.

20. The system of claim 19, wherein the controller includes further instructions for increasing an opening of the throttle during the drawing of intake air through the throttle bypass to rotate the turbine and drive the motor-generator; and decreasing an opening of the throttle during the drawing of intake air through the canister to purge the canister.

* * * * *